US005952781A

United States Patent [19]

Wang et al.

[11] Patent Number: 5,952,781

[45] Date of Patent: Sep. 14, 1999

[54] ELECTRODE FOR HIGH CONTRAST GAS DISCHARGE PANEL AND THE METHOD FOR MANUFACTURING THE SAME

[75] Inventors: Hong Wang, Wesley Hills; Daniel J. Devine, New Paltz, both of N.Y.

[73] Assignee: Matsushita Electric Industrial Co., Ltd., Osaka, Japan

[21] Appl. No.: 09/038,709

[22] Filed: Mar. 9, 1998

[51] Int. Cl.[6] ..... H01J 61/00

[52] U.S. Cl. ..... 313/567; 313/585; 313/586; 313/587

[58] Field of Search ..... 313/567, 422, 313/495, 497, 496

[56] References Cited

U.S. PATENT DOCUMENTS 4,556,620 12/1985 Thompson ..... 313/470
5,477,105 12/1995 Curtin et al. ..... 313/422
5,548,181 8/1996 Jones ..... 313/495
5,628,882 5/1997 O'Keefe et al. ..... 204/192.15

OTHER PUBLICATIONS

Materials Letters 18, (1994) 251–256, M. J. O'Keefe et al., "Reactive Sputter Deposition of Crystalline Cr/C/F Thin Films".

*Primary Examiner*—Sandra O'Shea
*Assistant Examiner*—Joseph Williams
*Attorney, Agent, or Firm*—Ohlandt, Greeley, Ruggiero & Perle

[57] ABSTRACT

A Cr—C—F crystalline film was found to be suitable for use as a black matrix layer for use in conjunction with a Cr/Cu/Cr PDP electrode. Furthermore, film stack including the foregoing Cr—C—F layer, a gradated Cr—C—F transition layer and a pure Cr film can be formed in an integrated sputter deposition process and can be used as a black matrix/adhesion layers in PDP Cu electrode.

10 Claims, 3 Drawing Sheets

ELECTRODE FOR HIGH CONTRAST GAS DISCHARGE PANEL AND THE METHOD FOR MANUFACTURING THE SAME

FIELD OF INVENTION

This invention relates to an electrode for gas discharge panels. More particularly, the invention relates to an electrode for a gas discharge panel including a black matrix layer that reduces the ambient light reflected to the viewer's eyes and enhances contrast. The invention is further directed to a method for forming a black matrix layer, an electrode including a black matrix layer and gas discharge panels incorporating such electrodes.

BACKGROUND OF THE INVENTION

A Cr—Cu—Cr (chromium-copper-chromium) multilayer film stack has been recognized as one of the more favorable structures for gas discharge panel, or plasma display panel (PDP) electrodes. In such an electrode, the Cu layer serves as the major current carrier. The bottom Cr layer is used to improve adhesion between the Cu layer and the glass substrate, panel or plate, while the top Cr layer protects the Cu layer from oxidation during later thermal manufacturing processes and serves as a reflective surface to reflect image light blocked by the electrode back into the plasma cell.

Cr—Cu—Cr multilayer films can be manufactured using a sputter deposition process. However, because sputtered Cr films have a metallic white color, the bottom Cr layer decreases the image contrast of the plasma display when reflecting ambient light back to viewer's eyes. To improve the contrast of the plasma display, an anti-reflective layer, also referred to in the art as a black matrix layer, can be deposited on the glass panel prior to the deposition of the Cr adhesion layer. The purpose of the black matrix layer is to reduce the amount of light reflected from the Cr surface.

An effective black matrix layer should have a dark color with a low reflectivity and a high light absorption. The black matrix layer should preferably be etchable with the proper chemical etchant, most preferably either the same etchant used to etch the Cr adhesion layer so that the anti-reflective layer can be etched together with the Cr adhesion layer, or an etchant that allows suitable selectivity to etch the metallic Cr and Cu layers. Further, the black matrix layer should provide good adhesion with both the glass substrate, panel or plate and the Cr adhesion layer.

Although any film meeting the above requirements can be used as a black matrix layer, the use of a film formed of a Cr-based compound is particularly advantageous. With Cr-based compounds it is possible to deposit the film using reactive sputtering and a pure Cr target. This allows the black matrix layer and the Cr adhesion layer to be deposited sequentially in the same chamber, eliminating the need for an independent black matrix layer deposition. Also, films formed of Cr-based compounds will generally provide etching properties similar to those of pure Cr films. This allows one to etch both the black matrix layer and adhesion layer in a single process step and negates the need for an additional etching step and the equipment needed to conduct the additional etching step.

A method of depositing a series of films of Cr, C and F by reactive sputtering, using a Cr metal target and an Argon-hexafluorethane ($C_2F_6$) gas mixtures at various ratios, is disclosed in U.S. Pat. No. 5,628,882 to O'Keefe et al., the subject matter of which is incorporated herein by reference. (See also, *Reactive Sputter Deposition of Crystalline Cr/C/F Thin Films*, O'Keefe et al., *Materials Letters* 18 (1994) 251–256). The film composition (atomic percent) was in the range of (35–55) Cr, (20–25) C, and (20–45) F, and was controlled by varying the Ar:$C_2F_6$ ratio. The films were determined to be crystalline and the composition was independent of substrate selection. Since PDP electrode applications were not considered in the patent, the film properties were not evaluated with regard to suitability for use as a black matrix layer Accordingly, it is an object of the present invention to provide an effective black matrix layer that is compatible with a PDP electrode including a Cr/Cu/Cr film stack.

It is a further object of the invention to provide a black matrix layer that is integrated with the adhesion layer of a Cu-based PDP electrode.

It is another object of the invention to provide a method of forming an integrated black matrix/adhesion layer in a continuous sputtering deposition processes that can be performed in a single vacuum chamber.

SUMMARY OF THE INVENTION

In accordance with the foregoing principles and objects, the present invention provides a Cr/Cu/Cr PDP electrode integrated with a black matrix layer formed of a crystalline Cr—C—F film. Further, the present invention provides a film stack including a Cr—C—F film, which functions as a black matrix layer, a gradated Cr—C—F transition layer, and a pure Cr film that serves as the adhesion layer of a Cu PDP electrode. The present invention also provides a method of depositing the foregoing film stack in a continuous sputtering deposition process that can be performed in a single vacuum chamber.

DETAILED DESCRIPTION OF THE INVENTION

Figure 1:
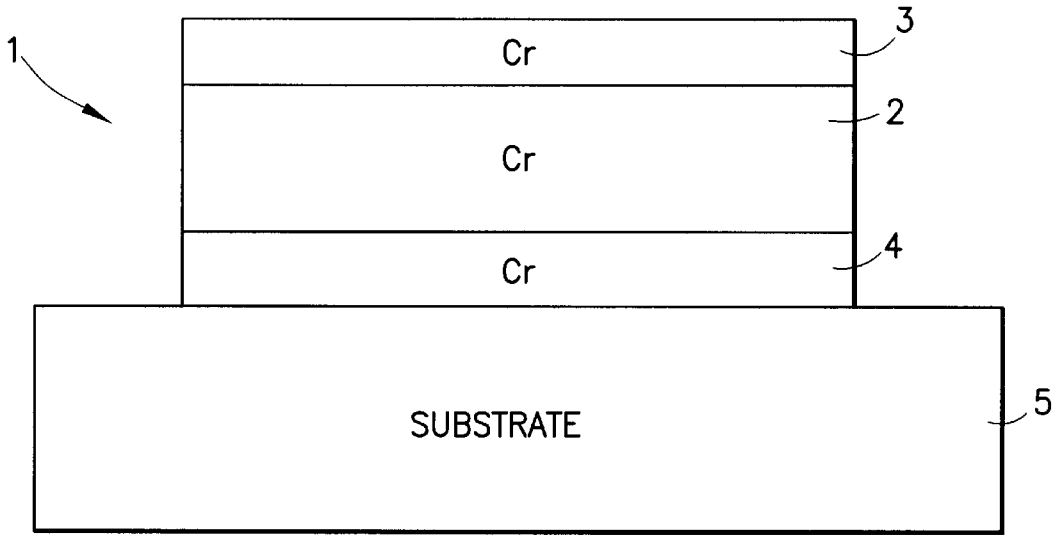
FIG. 1 PRIOR ART
FIG. 1 is a sectional view of a prior art Cr/Cu/Cr multilayer film stack plasma display panel electrode.

A conventional Cu-based PDP electrode is shown in FIG. 1. The exemplified electrode 1 includes a conductive Cu layer 2 that serves as the major current carrier of the electrode. Conductive Cu layer 2 is positioned between two Cr layers including a top Cr layer 3 that protects the Cu layer from oxidation and a bottom Cr layer 4, which functions as an adhesion layer capable of adhering electrode 1 to a substrate 5.

Two Cr—C—F films were deposited using the method described in U.S. Pat. No. 5,628,882. The chemistry and microstructure of the films are characterized in the referenced patent. In accordance with the present invention, the suitability of such films for use as a black matrix layer was determined as follows.

Figure 2:
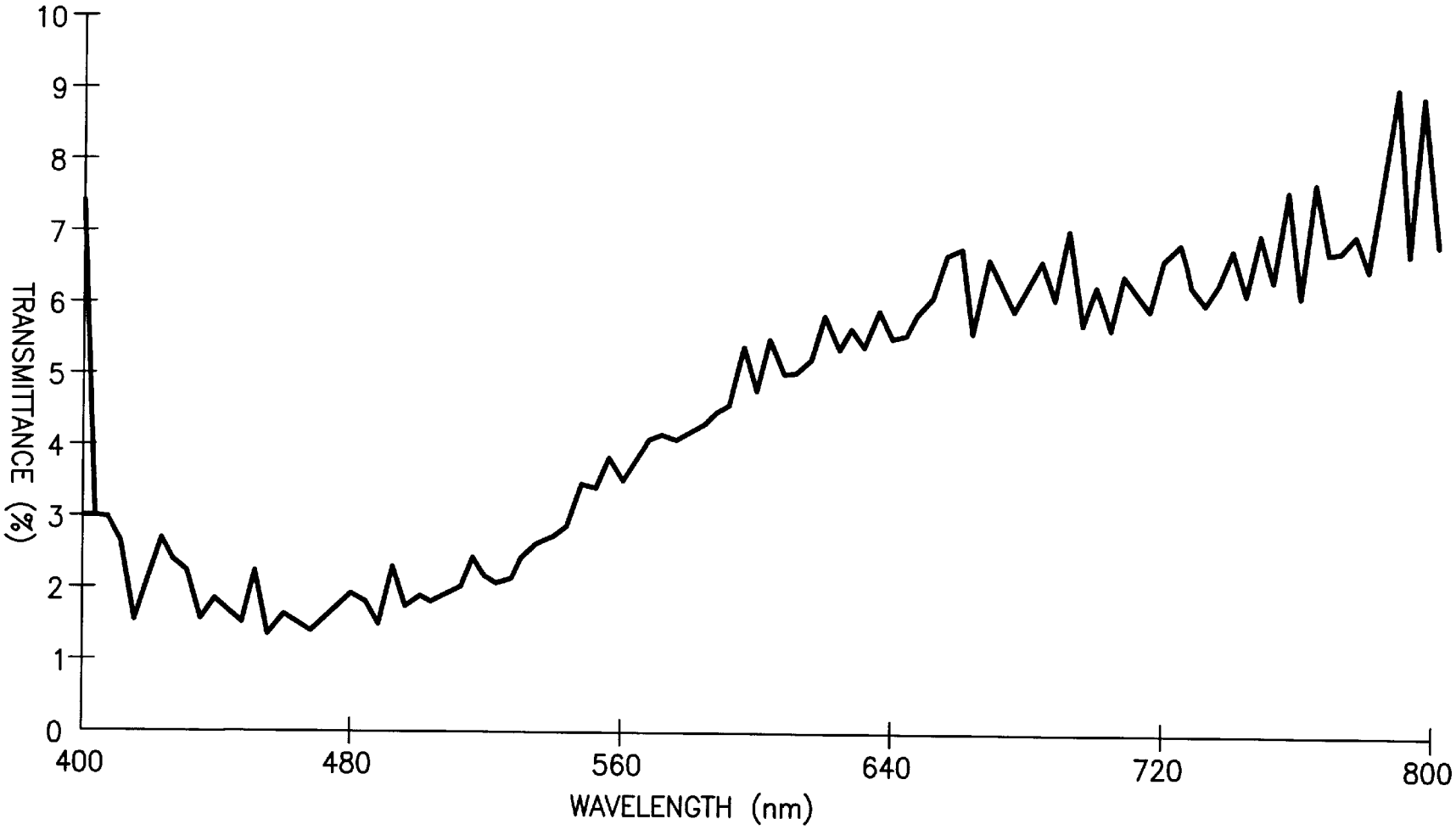
FIG. 2 is a plot of optical transmittance as a function of wavelength for Cr—C—F film #1.
Figure 3:
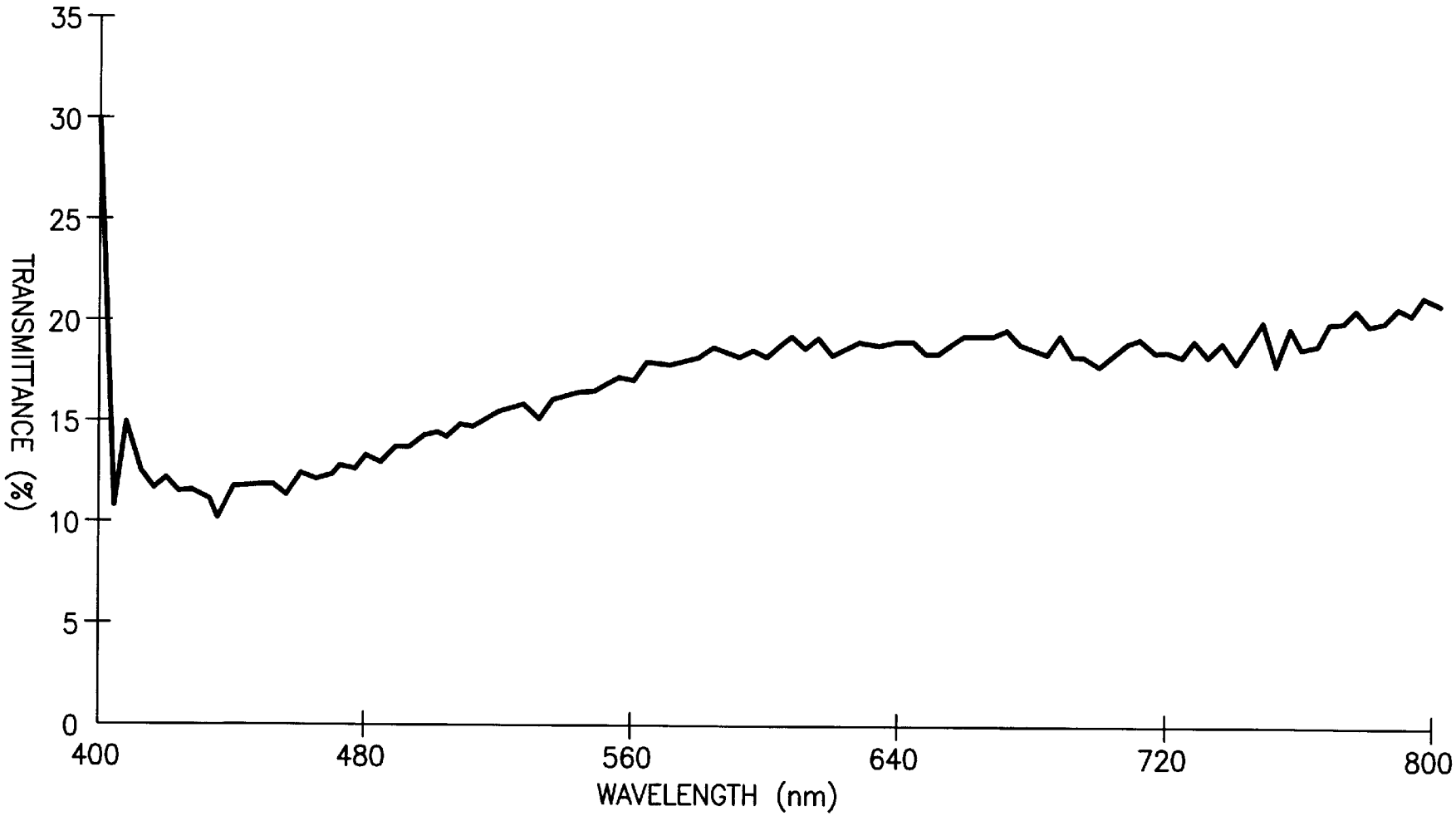
FIG. 3 is a plot of optical transmittance as a function of wavelength for Cr—C—F film #2.

The thickness of the films were measured with a Dektak II surface profilometer (Veeco Instruments, Inc.). The color of the films was examined visually by human eye. The optical transmittance of the film for the visible light region was measured by using a SpectraPro 275 0.275 Meter Focal Length Monochrometer (Acton Research Corp.) in combination with a Hamamatsu R 928 photomultiplier tube. FIG. 2 and 3 plot the optical transmittance of the films as a function of light wavelength. The etchability of the films was tested with a typical etchant for pure Cr. Adhesion was evaluated by a peeling test using Scotch tape (3M). The test results are summarized in the following table.

| Sample | Cr—C—F #1 | Cr—C—F #2 |
|---|---|---|
| Composition (at. %) | Cr:C:F = 57:25:18 | Cr:C:F = 35:24:41 |
| Thickness (A) | 2000 | 4000 |
| Color | Dark Brown | Dark Brown |
| Average Transmittance (%): (Visible Light) | <7 | <18 |
| Etchability: Etched with etchant for Cr | Yes | Yes |
| Adhesion with Glass: Peeling test W/ Scotch tape | Good | Good |

These results demonstrate that the films are suitable for use as a black matrix layer for use in conjunction with a PDP electrode.

Since both Cr—C—F black matrix film and Cr adhesion layer are deposited by sputtering using a Cr target, the two layers can be manufactured in the same vacuum chamber in a sequential, continuous process. The Cr—C—F layer can be deposited first using a mixture of Argon (Ar) and hexafluorethane ($C_2F_6$) gasses in a suitable ratio. When the film reaches the desired thickness, preferably from about 1000 to about 5000 Angstroms, the $C_2F_6$ gas flow rate is gradually reduced to zero, producing a transition region in which the composition transitions smoothly from Cr—C—F to pure Cr. The thickness of this transition region can be controlled by controlling the rate at which the $C_2F_6$ gas flow is reduced. A layer of pure Cr film is then deposited by continuing the sputtering operation in the absence of $C_2F_6$ gas.

The method of the present invention combines two separate deposition procedures into one integrated process to create a film stack that functions as both a black matrix layer (Cr—C—F film) and an adhesion layer (Cr film) of the electrode, with no abrupt interface between the films. By forming an integrated black matrix/adhesion layer in accordance with the foregoing process, problems associated with a lack of adhesion between the black matrix layer and the adhesion layer of the electrode are avoided. Further, no additional vacuum chamber is required for black matrix film deposition.

Figure 4:
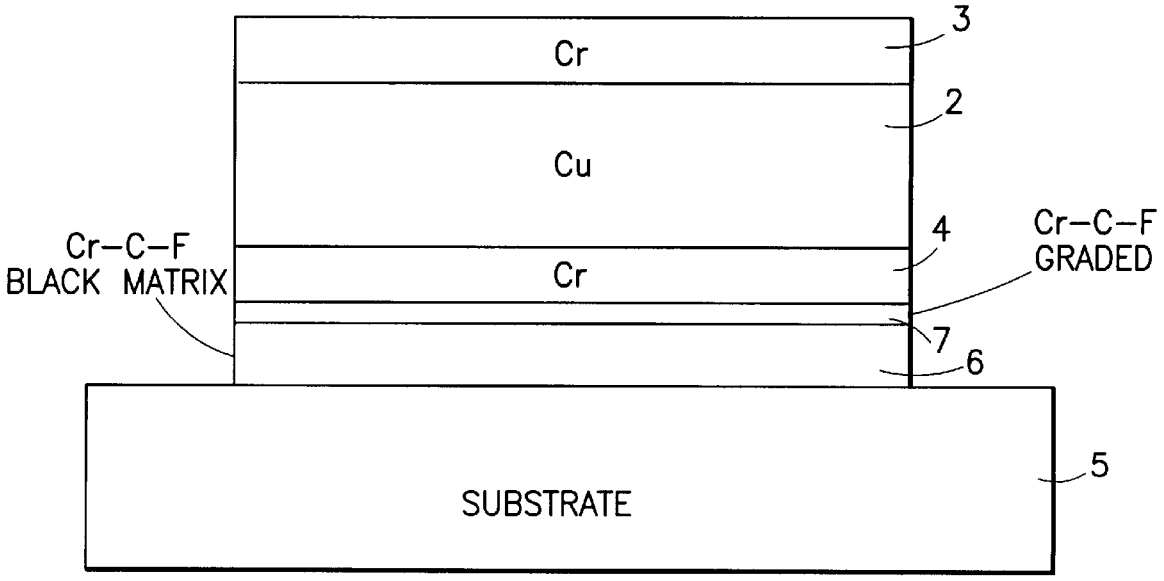
FIG. 4 is a sectional view of a Cr/Cu/Cr multilayer PDP electrode in accordance with one embodiment of the present invention formed with an integrated black matrix/adhesion layer including a Cr—C—F layer, a gradated Cr—C—F transition layer and a pure Cr layer.

The integrated black matrix/adhesion layer can then be placed in a second vacuum chamber for deposition of the Cu, followed by deposition of the upper Cr layer using conventional techniques in order to provide an electrode/black matrix layer. The resulting electrode/black matrix layer will be as shown in FIG. 4. As shown in FIG. 4, the electrode/black matrix layer is formed with an integrated black matrix/adhesion layer including a black matrix layer 6, and a transition region 7 deposited on substrate 5 in a continuous sputtering deposition process along with the adhesive bottom Cr layer 4. The conductive Cu layer 2 and top Cr layer 3 are subsequently deposited on bottom Cr layer 4 in separate sputtering operations.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed:

1. A gas discharge panel including a transparent plate, a gas discharge electrode and a black matrix layer positioned between said transparent plate and said gas discharge electrode, said black matrix layer comprising a thin film of chromium/carbon/fluorine.

2. The gas discharge panel of claim 1, wherein said gas discharge electrode comprises a conductive layer formed of a thin film of conductive material positioned between a thin film of a material resistant to oxidation and a thin film formed of a material that can be adhered to said black matrix layer.

3. The gas discharge panel of claim 2, wherein said black matrix layer is a thin film of chromium/carbon/fluorine, said conductive material is copper, said material resistant to oxidation is chromium and said material that can be adhered to said black matrix layer is chromium.

4. The gas discharge panel of claim 3, further including a transition region between said black matrix layer and said thin film of chromium that can be adhered to said black matrix layer, said transition region comprising a gradated region of chromium/carbon/fluorine in which carbon and fluorine content of said transition region decreases as a distance decreases from said thin film of chromium that can be adhered to said black matrix layer.

5. The gas discharge panel of claim 1, wherein said transparent plate is formed of glass.

6. The gas discharge panel of claim 1, wherein an overall thickness of said black matrix layer is within a range from about 1000 to about 5000 Angstroms.

7. The gas discharge panel of claim 4, wherein each of said black matrix layer, said transition layer, said adhesive layer, said conductive layer and said layer resistant to oxidation are sequentially deposited on said transparent plate.

8. A black matrix layer for a gas discharge panel, said black matrix layer comprising a thin film of chromium/carbon/fluorine.

9. The black matrix layer of claim 8, further comprising an adhesion surface to which a conductive layer of a gas discharge electrode can be adhered, said black matrix layer including a first portion extending from a first side of said black matrix layer and having a thickness in which a composition of said layer is substantially uniform, and a gradated transition region extending between said first portion and said adhesion surface, wherein the carbon and fluorine content gradually diminishes in a direction of said adhesion surface.

10. The black matrix layer of claim 9, wherein said first portion and said transition region comprise chromium/carbon/fluorine and said adhesion surface is substantially pure chromium.

* * * * *